US008327583B2

(12) United States Patent
Reimer et al.

(10) Patent No.: US 8,327,583 B2
(45) Date of Patent: Dec. 11, 2012

(54) COUNTER WEIGHT DOOR AND PULLEY ASSEMBLY THEREFORE

(75) Inventors: Greg Reimer, Steinbach (CA); Dennis Braun, Grunthal (CA); Richard Klassen, Steinbach (CA); Walter Toews, Kleefeld (CA)

(73) Assignee: Hanover Door Systems (1996) Inc., Steinbach, Manatoba (CA)

( * ) Notice: Subject to any disclaimer, the term of this patent is extended or adjusted under 35 U.S.C. 154(b) by 1028 days.

(21) Appl. No.: 12/115,440

(22) Filed: May 5, 2008

(65) Prior Publication Data

US 2009/0272039 A1 Nov. 5, 2009

(51) Int. Cl.
*E05D 15/38* (2006.01)

(52) U.S. Cl. ..... 49/197; 49/445; 49/447; 49/199; 49/200; 474/144; 474/148; 474/150; 474/166; 474/174; 160/190; 160/193; 160/189

(58) Field of Classification Search ..... 49/445, 49/447, 448, 197, 199, 200; 474/144, 148, 474/150, 166, 174
See application file for complete search history.

(56) References Cited

U.S. PATENT DOCUMENTS

| | | | | | |
|---|---|---|---|---|---|
| 1,481,847 | A * | 1/1924 | McCloud | 49/200 |
| 1,875,101 | A * | 8/1932 | Morrell | 174/57 |
| 3,038,535 | A * | 6/1962 | Stroup et al. | 160/191 |
| 3,931,748 | A * | 1/1976 | Tertinek et al. | 74/606 R |
| 5,581,939 | A * | 12/1996 | Regan et al. | 49/139 |
| 6,145,568 | A * | 11/2000 | Lundstrom | 160/84.02 |
| 6,434,886 | B1 * | 8/2002 | Johnson et al. | 49/197 |
| 7,367,277 | B2 * | 5/2008 | Bowman | 114/102.12 |
| 2006/0169961 | A1 * | 8/2006 | Ledford | 254/342 |
| 2007/0069538 | A1 * | 3/2007 | Dukate et al. | 294/82.12 |

* cited by examiner

*Primary Examiner* — Katherine w Mitchell
*Assistant Examiner* — Clarence W Mayott, III
(74) *Attorney, Agent, or Firm* — Kyle R. Satterthwaite; Ryan W. Dupuis; Ade & Company, Inc.

(57) ABSTRACT

A pulley assembly for an overhead counter weight door features a base plate and a support arrangement carried on and spaced from the base plate so that the base and support arrangements face toward one another. A shaft is carried on the base plate and the support arrangement to extend therebetween with a pulley supported on the shaft between the base plate and the support arrangement for rotation about an axis defined by the shaft. A plurality of wall sections extends between the base plate and the support arrangement to establish connection therebetween radially outward from the shaft beyond an outer periphery of the pulley on more than two sides thereof.

12 Claims, 6 Drawing Sheets

COUNTER WEIGHT DOOR AND PULLEY ASSEMBLY THEREFORE

FIELD OF THE INVENTION

This invention relates generally to an improved pulley assembly for overhead counter weighted doors.

BACKGROUND OF THE INVENTION

Pulleys are used in countless mechanical systems to change the direction of an applied force, transmit rotational motion or provide a mechanical advantage. In some larger scale systems or applications where significant loads are involved, pulley assemblies or installations must be sufficiently robust to reliable handle such loading in a safe manner. One example of a system involving significant pulley loads is a counter weighted overhead door system used to raise and lower a large overhead door used to obstruct and reveal a large framed opening in the wall of a building. Conventionally, pulley assemblies in these door opening systems are of a type having the pulley sheave carried on a shaft supported on opposite sides the pulley by a pair of plates that, except for the shaft, are interconnected only at either one end or two opposed ends of this plate pairing. With such limited support, a pulley of this type may not be robust enough to the reliably handle the weight involved in larger overhead door applications. As a result, there is a desire for an overhead door pulley assembly providing improved safety and load handling capabilities.

SUMMARY OF THE INVENTION

According to a first aspect of the invention there is provided a pulley assembly for a counter weight door comprising:

a base plate;

a support arrangement carried on and spaced from the base plate so that the base and support plates face toward one another;

a shaft carried on the base plate and the support arrangement to extend therebetween;

a pulley supported on the shaft between the base plate and the support plate for rotation about an axis defined by the shaft; and a plurality of wall sections extending between the base plate and the support arrangement to establish connection therebetween radially outward from the shaft beyond an outer periphery of the pulley on more than two sides thereof.

Preferably the wall sections extending between the base plate and the support arrangement are located at spaced-apart positions angularly spaced about the shaft.

Preferably angular spacing measured about the shaft between each adjacent pair of wall sections is equal.

Preferably the plurality of wall sections comprises four wall sections.

The plurality of wall section may consist of only these four wall sections.

Preferably each wall section is rectangular.

Preferably the support arrangement comprises a pair of parallel plate sections crossing one another on a side of the pulley opposite the base plate, each plate section being connected to the base plate by respective wall sections.

Preferably each plate section is rectangular and is connected to the base plate by the respective wall sections at opposite ends of the plate section.

Preferably the parallel plate sections cross one another at right angles.

Preferably each plate section is defined by a central portion of respective U-shaped section and the respective wall sections comprise legs of the U-shaped section projecting toward the base plate at opposite ends of the central portion.

Each wall section may comprise a mounting flange projecting inward along the base plate and being fastened thereto.

Preferably the shaft is rotatably supported on the base plate and the support arrangement and the pulley is fixed to the shaft for rotation therewith.

Preferably there are provided bearings fixed to the base plate and the support arrangement to rotatably support the shaft.

Preferably there is provided a first bearing fixed to the base plate, a second bearing mounted on support arrangement on a side thereof facing the base plate and a third bearing mounted on the support arrangement on an opposite side thereof facing away from the base plate.

Preferably the bearings are flange bearings.

The shaft may extend through the support assembly to a location outside a space defined between the base plate and the support arrangement. A driveable member may be fixed to the shaft outside there space defined between the base plate and the support arrangement. In this instance, preferably the drivable member comprises a sprocket arranged for receipt of a chain thereabout.

Preferably the pulley assembly is provided in combination with in combination with a counter weight door, the combination comprising:

two guides each arranged to be located on a respective sides of an opening on a building;

a door which is arranged to be supported on respective side thereon by the guides, the door having a plurality of panels each connected to the next one of the panels for common movement vertically in the guides;

a counter weight system coupled to the door for movement of the door within the guide means; and, a pulley system having:

a first guide pulley mounted adjacent a first side of the door and a second guide pulley mounted adjacent a second side of the door, at least one of the guide pulleys being defined by the pulley of the pulley assembly;

a first elongate member fixed at a first end of the first elongate member to the door and extending through the first pulley;

a second elongate member fixed at a first end of the second elongate member to the door and extending through the second pulley;

the second guide pulley having two pulley elements in a fixed rotatable relationship for receiving the first and second elongate members respectively, the first and second elongate members each extending through a third pulley at the counter weight system and each having a second end thereof anchored anchored to a fixed point.

According to a second aspect of the invention there is provided a counter weight door comprising:

two guides each arranged to be located on a respective sides of an opening on a building;

a door which is arranged to be supported on respective side thereon by the guides, the door having a plurality of panels each connected to the next one of the panels for common movement vertically in the guides;

a counter weight system coupled to the door for movement of the door within the guide means; and, a pulley system having:

a first guide pulley mounted adjacent a first side of the door;

a second guide pulley mounted adjacent a second side of the door;

a first elongate member fixed at a first end of the first elongate member to the door and extending through the first pulley;

a second elongate member fixed at a first end of the second elongate member to the door and extending through the second pulley;

the second guide pulley having two pulley elements in a fixed rotatable relationship for receiving the first and second elongate members respectively, the first and second elongate members each extending through a third pulley at the counter weight system and each having a second end thereof anchored anchored to a fixed point;

wherein at least one of the guide pulleys is defined by the pulley assembly according to the first aspect of the invention.

Preferably the second guide pulley is defined by the pulley assembly, the pulley assembly comprising a driveable member fixed to the shaft outside the space defined between the base plate and the support arrangement and arranged to be driven by a motor such that the door is raised and lowered.

Preferably the driveable member is a sprocket arranged to receive a chain from the motor.

BRIEF DESCRIPTION OF THE DRAWINGS

In the accompanying drawings, which illustrate an exemplary embodiment of the present invention.

DETAILED DESCRIPTION

Figure 4:
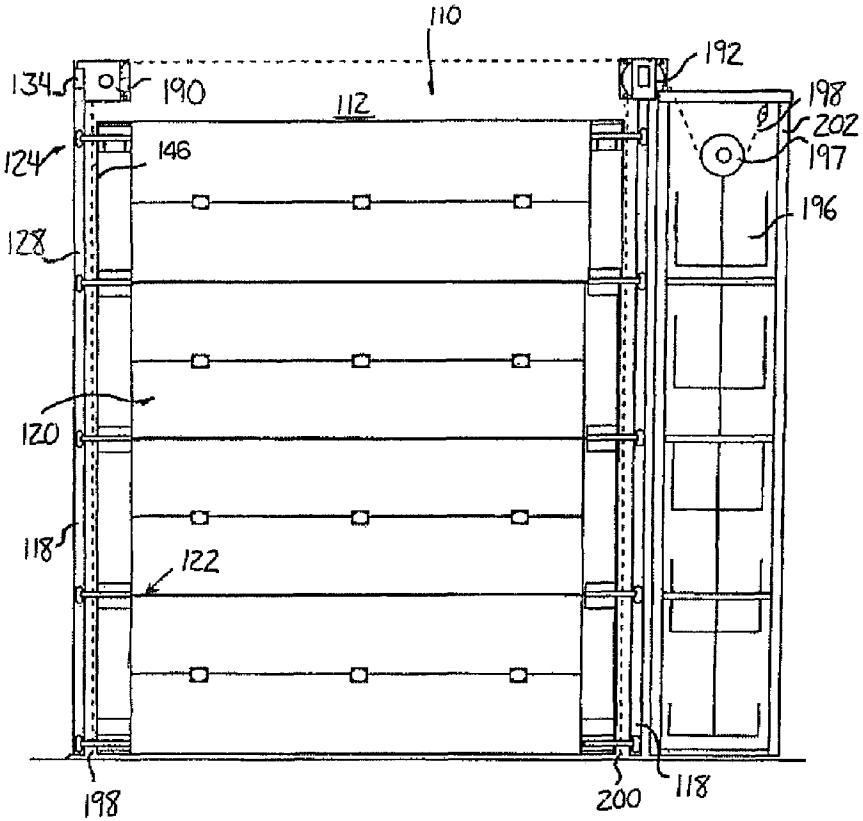
FIG. 4 is an elevational view of a prior art counter weighted overhead door system into which a pulley assembly of the present invention may be substituted.
Figure 5:
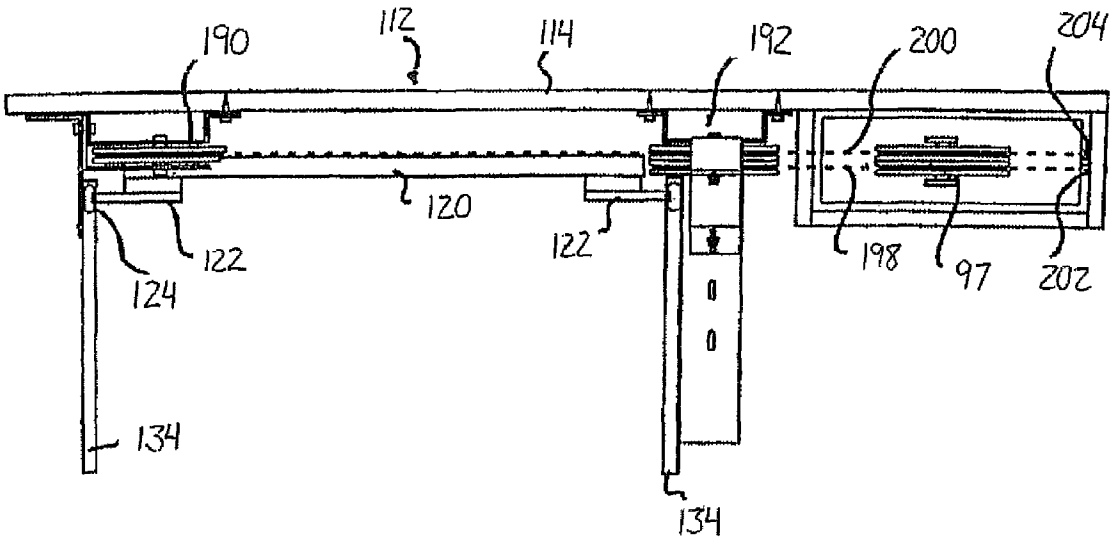
PRIOR ART FIG. 5
FIG. 5 is a partial overhead plan view of the prior art counter weighted overhead door system of FIG. 4.

FIGS. 4 and 5 show a prior art overhead counter weight door installation. A pair of spaced apart guide rail members 118 are arranged with one on each side of an opening 112 in a building wall 114, each having a substantially vertical portion 128 fixed to the wall 114 at its top end adjacent a respective side of the opening and a substantially horizontal portion 134 extending rearward further into the building from a curved connection between the two portions. A plurality of door panels 120 are aligned and adjacent one another with a plurality of pivot connections 122 between adjacent panels for pivoting about a respective axis extending perpendicularly between the rail members. Guide rail followers 124 at opposite sides of the door panels engage respective ones of the guide members 118 to limit movement of the doors panels to motion generally therealong during lifting and lowering of the door. First and second guide pulley assemblies 190, 192 are mounted to the wall 114 adjacent the first and second sides of the door respectively, the second pulley assembly 192 having either two pulleys fixed to one another for rotation together or a single pulley featuring two or more peripheral grooves therein. A plurality of counter weights 196 are arranged adjacent the second side of the door and provide a counter balancing force to the weight of the door. Connection means 197 are provided for connecting the plurality of counter weights 196 to each other and to the door 110. First and second elongate members 198 and 200 are each fixed at a first end to the door 110 adjacent first and second sides thereof. The first elongate member 198 extends from the first side 146 of the door 110 over the pulley of the first guide pulley assembly 190 laterally across the door 110 and over one pulley, or one groove of a two groove pulley, of the second guide pulley assembly 192 to a second end 202. The second elongate member 200 extends from the second side 148 of the door 110 and over a second pulley, or the second groove of a two-groove pulley, of the second pulley assembly 192 to a second end 204. The first and second elongate members 198 and 200 are connected to the connection means 197 adjacent the respective second ends 202 and 204 such that movement of the door 110 causes counter movement of the counter weights 196. A sprocket may be fixed to the pulley(s) of the second pulley assembly for driving by a motor to effect rotation of the pulleys and thereby lift the door by way of the flexible members.

Figure 6:
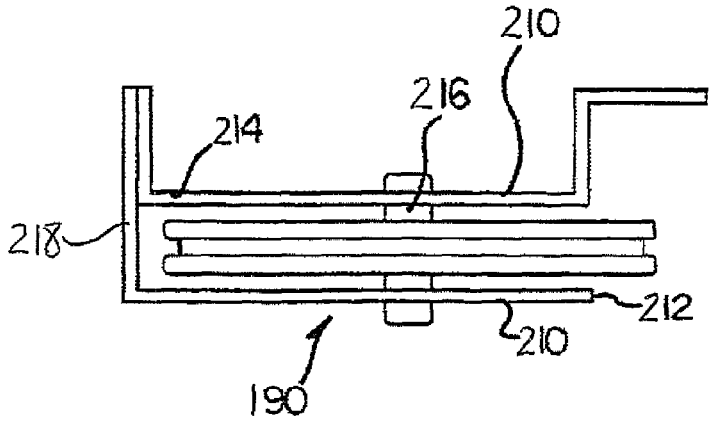
PRIOR ART FIG. 6
FIG. 6 is an overhead plan view of a first pulley assembly of the prior art counter weighted overhead door system of FIGS. 4 and 5.
Figure 7:
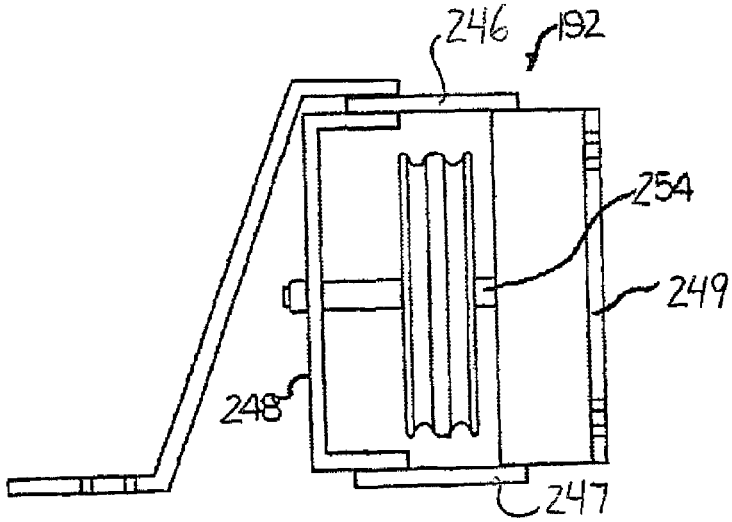
PRIOR ART FIG. 7
FIG. 7 is a side elevational view of a second pulley assembly of the prior art counter weighted overhead door system of FIGS. 4 and 5.

The pulley assemblies of this prior art overhead door are of the types briefly outlined herein above. The first pulley assembly 190 on the first side 146 of the door, shown in isolation in FIG. 6, comprises a pair of parallel spaced apart plate members 210 extending from a first end 212 to a second end 214, an axle member 216 extending between the plate members 210 with the pulley arranged parallel to the plate members 210 and mounted on the axle 216, and an attachment plate 218 arranged perpendicular to the pair of parallel plates 210 and fixed at one common end thereof. Other than the axle or shaft 216, the attachment plate 218 serves as the only other connection of the between the parallel plate members 210. The second pulley assembly, shown in isolation in FIG. 7, features a double pulley and is of the other type of pulley assembly briefly outlined in the background herein, featuring only two connections 246, 247 other than the shaft between the parallel spaced apart plate members 248, 249 supporting the shaft 254 with the pulley between them, one such connection at each of two opposing ends of this pair of plates.

Figure 1:
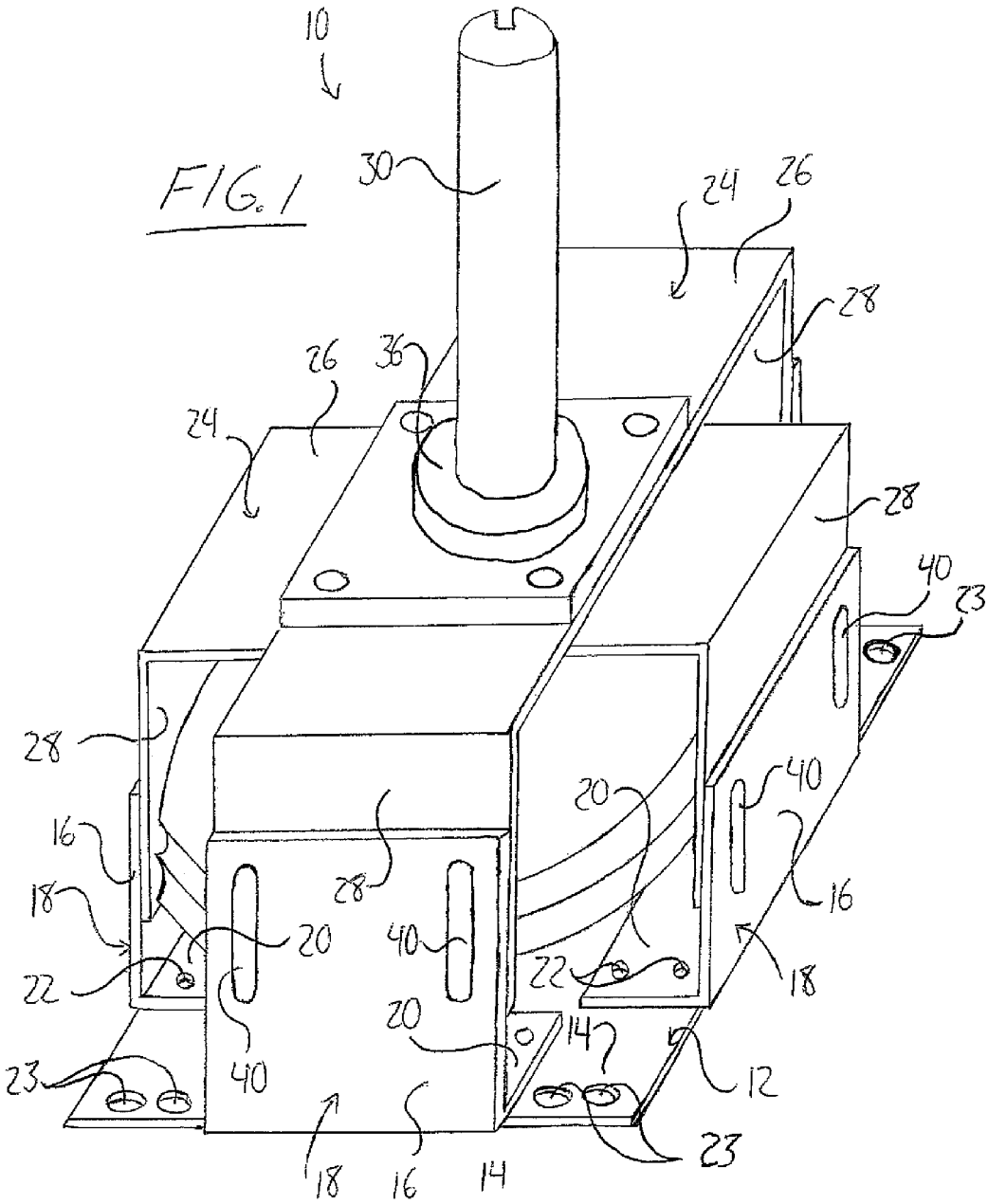
FIG. 1 is a perspective view of a pulley assembly according to the present invention.
Figure 2:
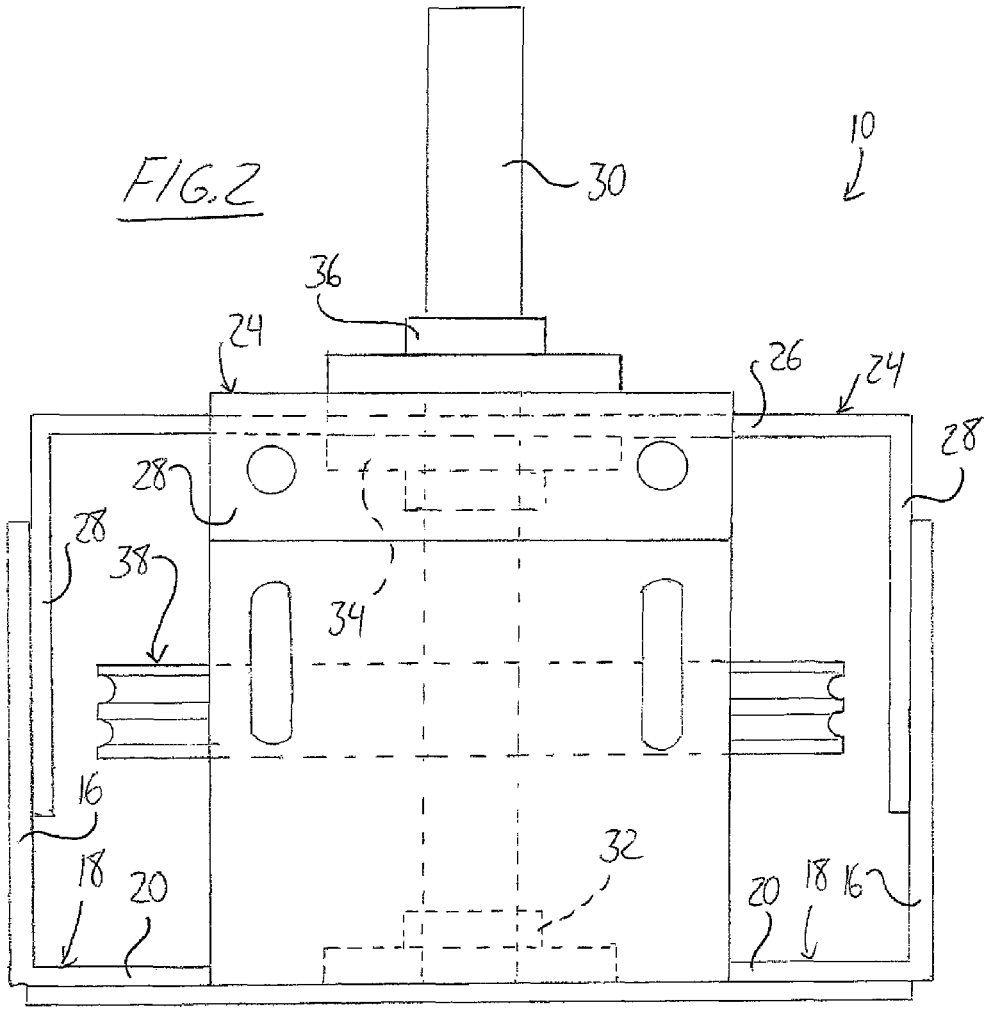
FIG. 2 is a side elevational view of the pulley assembly of FIG. 1.
Figure 3:
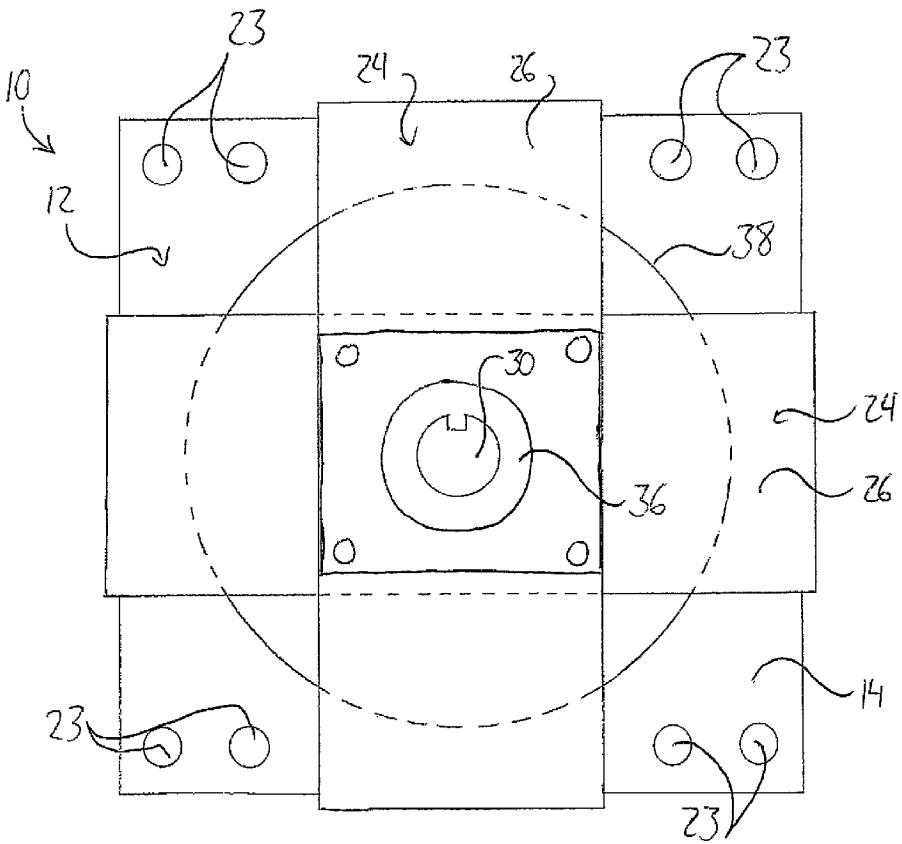
FIG. 3 is an overhead plan view of the pulley assembly of FIGS. 1 and 2.

As shown in FIGS. 1 to 3, a bearing assembly 10 according to one embodiment of the present invention features a rectangular base plate 12 that on one side thereof defines a mounting face 14. Along a partial length of each of the base plate's four linear edges, a respective base wall 16 centered along this edge projects perpendicularly from the mounting face 14 of the base plate 12. In the illustrated embodiment, each base wall 16 is defined by one of two legs of an L-shaped right angle bracket 18 having the other leg 20 fixed to the base plate 12 flush and flat against the mounting face 14 thereof to define a mounting flange, with fastener holes 22 in this mounting flange leg 20 positioned in alignment with corresponding holes in the base plate 12 to facilitate passage of suitable fasteners (not shown) thereto to fix the right angle bracket 18 to the base plate 12. For example, bolts may be passed through the base plate 12 from the side thereof opposite the right angle bracket 18 to have nuts threaded onto them from the side of the mounting flange leg 20 opposite the base plate to clamp the right angle bracket 18 and base plate 12 together. To allow for flush fitting of the base plate 12 against a flat surface of a structure on which the pulley is to be mounted, the side of the base plate 12 opposite the brackets 18 may be recessed at the position of its bracket-clamping fastener holes so that the heads the fasteners do not project from the base plate 12 at that side. The base plate 12 also features additional fastener holes 23 proximate the corners thereof which the brackets 18 do not reach along the base plate's edges, to facilitate mounting of the pulley assembly 10 to a flat surface of an appropriate support structure.

Between each pair of brackets 18 disposed at opposite edges of the base plate 12 is a channel piece 24 having a squared-off U-shaped cross section featuring three planar or plate-like portions: a central plate portion 26 and two leg portions 28 projecting perpendicularly from the plate section 24 at opposite ends thereof. The two legs 28 of the channel piece 24 are positioned parallel to the base walls 16 of the two respective brackets 18 and the central portion 26 has a length chosen to position the two legs 28 just inward of base walls 16 over the mounting flange legs 20 of the respective brackets 18 mounted to the base plate 12. The base walls 16 of each pair of opposed brackets 18 are fastened to the legs 28 of the U-shaped channel piece in a generally flush face-to-face arrangement to together define wall sections supporting the central portion 26 of the U-shaped channel piece 24 at a distance from the mounting face 14 of the base plate 12 in an orientation parallel thereto. With each opposed pairing of brackets 18 having a respective U-shaped channel piece 24 so installed, the central plate-like portions 26 of the two channel pieces 24 cross at right angles over the center of the base plate's mounting face 14. To allow this to happen, the two channel pieces 24 are positioned to situate one of the central portions 26 at a slightly greater distance from the mounting face 14 of the base plate 12, the other central portion thus passing between the base plate 12 and the central portion further therefrom.

A hole is provided at a central location in the central portion 26 of each U-shaped channel piece 24 so that these two holes axially align with one another with the channel pieces positioned as described above. As shown in FIG. 2, three flange bearings are mounted on the base plate 12 and the channel pieces 24 in axial alignment with one another to rotatably support a shaft 30 positioned to pass through the aligned holes in the channel pieces so as to extend perpendicularly away from the mounting face 14 of the base plate 12 through the two channel pieces 24. A first flange bearing 32 is fastened flush against the mounting face 14 of the base plate 12 to position its rotational axis perpendicular to the base plate 12 coinciding with the axis of the aligned holes in the channel pieces 24 through which the shaft 30 is to extend. A second flange bearing 34 is fastened to the channel piece central portion nearest the mounting face 14 of the base plate 12 flush against a side of this central portion facing the base plate's mounting face 14. A third flange bearing 36 is fastened to the other outermost channel piece central portion on a side thereof facing away from the base plate mounting face 14. The crossing central portions 26 of the two U-shaped pieces 24 thus define a support arrangement positioned at a distance outward from the mounting face 14 of the base plate 12 to support the shaft 30 at a distance from the base plate 12. Each flange bearing may be fastened in place by bolts (not shown) passed through its flange and the particularly body to which it is being mounted and threaded with a nut on the protruding bolt end opposite the bolt head. In the case of the second and third flange bearings, a single bolt set may be passed through the flanges of these aligned bearings and the two plate sections between them and threaded with nuts to clamp these four elements together.

A pulley 38 is fixed to the shaft 30 at a generally central position between the base plate 12 and the central portions 26 of the U-shaped pieces 24 for rotation with the shaft between the pairs of opposed wall sections carrying the U-shaped channel members on the base plate 12. In the illustrated embodiment, the pulley assembly features a two-groove pulley sheave arranged to receive two separate flexible elements or lengths of cable thereabout in a side-by-side arrangement, but it will be appreciated that other pulley types, for example single or triple groove pulleys, may alternatively be used as warranted by the particular application or context in which the assembly is to be used. Multiple single-groove pulleys may be fastened together to provide a multi-groove pulley arrangement, but a single integral multi-groove pulley, for example of solid steel, may be preferred for relatively more heavy duty applications. The wall sections defined by cooperation of the base walls 16 of the brackets 18 and the legs 28 of the U-shaped channel pieces are positioned centrally along their respective edges of the base plate 12 and the shaft is centered on the base plate 12 so that these wall sections are equally spaced about the rotational axis shared by the bearings, shaft and pulley by angular spacing of ninety degrees from center-to-center.

As seen in FIG. 2, the partial length of each base plate edge spanned by the respective wall section centered therealong is significantly less than the diameter of the pulley at the maximum depth of its peripheral grooves and the pulley's outermost diameter is less than the equal planar dimensions of the square base plate 12 (or less than the shorter of the two planar dimensions of the plate if not equal) and less than the distance between the opposite legs 28 of each channel member 24 along the plane of the base plate 12. This leaves spacing between the pulley periphery and the wall sections disposed outward therefrom in a radial direction of the rotational axis as well as significantly sized gaps between the wall sections at the corners of the base plate 12. These spaces and open corners provide room to accommodate passage of a cable or flexible element into and out of the partially enclosed pulley-containing space inward of the wall sections carrying the supporting arrangement defined by the central sections 26 of the U-shaped channel members 24 and the two flange bearings 34, 36 carried thereon.

In the illustrated embodiment, the shaft is keyed and projects away from the base plate 12 through the central portions 26 of the channel members 24 to an area outside the space defined between the base plate 12 and the support arrangement. This way, the shaft can be connected to a suitable drive system in this area outside the pulley housing defined by the assembly without worry of interference of drive system components by the wall sections supporting the channel member central portions 26. For example, a sprocket can be fixed to the protruding portion of the shaft for wrapping of a motor driven chain thereabout to effect driven rotation of the shaft 30 and pulley 38. In other embodiments, such a sprocket could instead could be fixed to the shaft in the spacing between the base plate 12 and the supporting arrangement if openings in or between the wall sections would safely allow the chain to run into this interior space of the housing in the application for which the assembly is being used. In view of this, and in view of possible uses of the pulley assembly that would not require connection to a drive source, the pulley assembly need not necessarily feature an externally projecting shaft.

As shown in FIGS. 1 and 2, two elongate slots 40 may be provided in the base wall 16 of each brackets 18 proximate opposite ends thereof to cooperate with corresponding holes in the respective leg 28 of the respective U-shaped channel member 24 to allow selection of a position at which fastening thereof to the bracket 18 is to take place during assembly of a pulley unit. The length of the slots is oriented perpendicular to the base plate 12. Holes of diameter similar to the slots in the legs 28 of a channel member 24 are moved along the slots by sliding the channel member perpendicularly toward and away from the mounting face 14 of the base plate 12 to set the desired distance between the base plate and the channel member's central portion 26. With a first of the two channel members installed by tightening of bolt and nut combinations through the respective leg holes at selected relative positions along the slots 40, the second channel member is installed by moving its central portion into a position against the central portion of the already installed inner channel member nearest the base plate 12 and similarly bolting it in place to the base walls 16 of its respective brackets 18.

As a result of the wall sections interconnecting the base plate and support arrangement at four positions about the rotational axis, and more specifically at all four sides of a square area closely bounding the pulley's periphery, the pulley assembly offers improved strength and durability relative to prior art pulley assemblies that, aside from the shaft, interconnect the shaft-supporting plates on opposite sides of the pulley at only one or both of two opposing ends of these plates, as the number of sides around the pulley at which support is provided is increased. It will be appreciated that this advantage would still be retained if the pulley assembly was alternatively produced without an arrangement for adjusting or selecting the spacing between the base plate and the support arrangement thereopposite. For example, in one alternate embodiment the channel members could be permanently and directly fastened to the base plate. Similarly, those of skill in the art will recognize that other components of the assembly may be fastened together using known methods other than the nut and bolt coupling described herein above.

Referring again to FIGS. 4 and 5, it will be appreciated that one or both of the prior art first and second pulley assemblies 190, 192 of the counter weight door 110 may be replaced with units featuring the advantageous pulley assembly structure of the present invention. In this case, the base plate 12 could be positioned vertically against the wall 114 and fastened thereto through fastener holes 23. Installed with the edges of the rectangular base plate 12 oriented horizontally and vertically, the perpendicularly crossing U-shaped channel members 24 would define horizontal and vertical braces or bridges spanning across the base plate to provide an improved level of support to the shaft outward from the attachment of the base plate 12 to the wall 114. Replacement of the prior art's second bearing assembly 192 with a single assembly of the present invention would require use of at least two pulleys interconnected for rotation together or a double groove or greater multi-grooved pulley to accommodate the first and second flexible elongate members connected to the door, and may feature the illustrated protruding shaft arrangement to allow motor driven operation of the door via chain driven sprocket fixed to the shaft outside the pulley-housing space for connection to a motor. A present invention pulley assembly used to replace the prior art first bearing assembly would not require or clearly benefit from including such features, but would function properly nonetheless if they were included.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A pulley assembly comprising:

a base plate;

a support arrangement carried on and spaced from the base plate so that the base plate and support arrangement face toward one another;

a shaft carried on the base plate and the support arrangement to extend therebetween;

a pulley supported on the shaft between the base plate and the support arrangement for rotation about an axis defined by the shaft; and a plurality of wall sections extending between the base plate and the support arrangement to establish connection therebetween radially outward from the shaft beyond an outer periphery of the pulley;

wherein the wall sections each have a selectively adjustable length in a direction in which said wall section extends between the base plate and the support arrangement so as to enable adjustment of a distance between the base plate and the support to select a different spacing therebetween;

wherein the plurality of wall sections extending between the base plate and the support arrangement consists of four wall sections that are disposed on four respective sides of the pulley and that each extend less than a diameter of the pulley along said respective side to leave a gap between adjacent wall sections at each corner of the base plate for feeding of the pulley from any said corner.

2. The pulley assembly according to claim 1 wherein the support arrangement comprises a pair of parallel plate sections crossing one over the other on a side of the pulley opposite the base plate, each plate section being connected to the base plate by respective wall sections on opposing sides of the pulley, one plate section being removable from the base plate independently of the other plate section.

3. The pulley assembly according to claim 2 wherein the parallel plate sections cross one another at right angles.

4. The pulley assembly according to claim 2 wherein each plate section is defined by a central portion of a respective U-shaped section and the respective wall sections comprise legs of the U-shaped section projecting toward the base plate at opposite ends of the central portion, the legs of one U-shaped section being detachable from the base plate independently of the other U-shaped section.

5. The pulley assembly according to claim 1 wherein each wall section comprises a mounting flange projecting inward along the base plate and being releasably fastened thereto.

6. The pulley assembly according to claim 1 wherein the shaft is rotatably supported on the base plate and the support arrangement and the pulley is fixed to the shaft for rotation therewith.

7. The pulley assembly according to claim 6 comprising bearings fixed to the base plate and the support arrangement to rotatably support the shaft.

8. The pulley assembly according to claim 6 comprising a first bearing fixed to the base plate, a second bearing mounted on support arrangement on a side thereof facing the base plate and a third bearing mounted on the support arrangement on an opposite side thereof facing away from the base plate.

9. The pulley assembly according to claim 7 wherein the bearings are flange bearings.

10. The pulley assembly according to claim 6 wherein the shaft extends through the support assembly to a location outside a space defined between the base plate and the support arrangement.

11. The pulley assembly according to claim 1 wherein each wall section comprises a base wall secured to the base plate and projecting toward the support arrangement, a leg extending from the support arrangement toward the base plate, an elongated slot in one of the base wall and the leg, and a fastener that is engageable through the elongated slot, repositionable therealong and operable to clamp the base wall and leg together, the slots of the wall sections being oriented in the direction extending between the base plate and the support arrangement so that adjustment of positions of the fasteners along the slots to set where the base walls and the legs are clamped together thereby adjusts the length of the wall sections between the base plate and the support arrangement.

12. The pulley assembly of claim 11 wherein each wall section comprises a hole defined in the other of the base wall and the leg of said wail section at a position aligned with the elongated slot, the fastener of each wall section being a removable fastener passing through said aligned hole and elongated slot.

* * * * *